US012516581B2

(12) United States Patent
Chen et al.

(10) Patent No.: US 12,516,581 B2
(45) Date of Patent: Jan. 6, 2026

(54) CORING TOOL, CORING METHOD, AND APPLICATION THEREOF

(71) Applicants: CHINA PETROLEUM & CHEMICAL CORPORATION, Beijing (CN); SINOPEC OILFIELD SERVICE CORPORATION, Beijing (CN); SINOPEC SHENGLI PETROLEUM ENGINEERING CO., LTD, Shandong (CN); DRILLING TECHNOLOGY RESEARCH INSTITUTE OF SINOPEC SHENGLI PETROLEUM ENGINEERING, Shandong (CN)

(72) Inventors: Zhongshuai Chen, Shandong (CN); Xueliang Pei, Shandong (CN); Zhonghua Wu, Shandong (CN); Zhihe Liu, Shandong (CN); Feng Liu, Shandong (CN); Wei Zhuang, Shandong (CN); Renlei Ning, Shandong (CN); Kai Gao, Shandong (CN); Guiting Wang, Shandong (CN); Haobo Li, Shandong (CN)

(73) Assignees: CHINA PETROLEUM & CHEMICAL CORPORATION, Beijing (CN); SINOPEC OILFIELD SERVICE CORPORATION, Beijing (CN); SINOPEC SHENGLI PETROLEUM ENGINEERING CO., LTD, Shandong (CN); DRILLING TECHNOLOGY RESEARCH INSTITUTE OF SINOPEC SHENGLI PETROLEUM ENGINEERING, Shandong (CN)

( * ) Notice: Subject to any disclaimer, the term of this patent is extended or adjusted under 35 U.S.C. 154(b) by 0 days.

(21) Appl. No.: 18/724,652

(22) PCT Filed: Dec. 27, 2022

(86) PCT No.: PCT/CN2022/142261
§ 371 (c)(1),
(2) Date: Jun. 27, 2024

(87) PCT Pub. No.: WO2023/125515
PCT Pub. Date: Jul. 6, 2023

(65) Prior Publication Data

US 2025/0059841 A1 Feb. 20, 2025

(30) Foreign Application Priority Data

Dec. 30, 2021 (CN) ..... 202111656748.3

(51) Int. Cl.
*E21B 25/10* (2006.01)

(52) U.S. Cl.
CPC ..... *E21B 25/10* (2013.01)

(58) Field of Classification Search
CPC ..... E21B 25/00; E21B 25/10; E21B 25/12
See application file for complete search history.

(56) References Cited

U.S. PATENT DOCUMENTS 3,878,904 A * 4/1975 Dobson ..... E21B 25/00 175/242
4,605,075 A * 8/1986 Radford ..... E21B 25/02 175/246

(Continued)

FOREIGN PATENT DOCUMENTS

CN 103775013 A 5/2014
CN 109812241 A 5/2019

(Continued)

*Primary Examiner* — D. Andrews
(74) *Attorney, Agent, or Firm* — NKL Law; Allen Xue

(57) ABSTRACT

A coring tool, a coring method, and use thereof are provided. The coring tool has a differential device for selective force (Continued)

transmission and a core gripping device for core cutting operations arranged within the housing. The core gripping device has a retractable core gripper, a slip-collar type core gripper and a shielding mechanism. The shielding mechanism is configured to be actuated by the differential device, so that the slip-collar type core gripper is shielded during coring operation and a first core cutting operation to avoid accidental core cutting operation, and to be exposed during a second core cutting operation to complete the whole core cutting operation.

17 Claims, 6 Drawing Sheets

(56) References Cited

U.S. PATENT DOCUMENTS

| | | | | |
|---|---|---|---|---|
| 4,606,416 | A * | 8/1986 | Knighton | E21B 25/14 175/251 |
| 11,131,147 | B1 * | 9/2021 | Berger | E21B 10/02 |

FOREIGN PATENT DOCUMENTS

| | | | |
|---|---|---|---|
| CN | 209780816 | U | 12/2019 |
| CN | 217632346 | U | 10/2022 |
| JP | 2000104480 | A | 4/2000 |

* cited by examiner

CORING TOOL, CORING METHOD, AND APPLICATION THEREOF

CROSS REFERENCE OF RELATED APPLICATIONS

This application is a U.S. national stage entry of PCT International Application No. PCT/CN2022/142261, filed on Dec. 27, 2022, which claims the priority of Chinese patent application No. 202111656748.3 entitled "JAW DIFFERENTIAL GAP-ADJUSTABLE DOUBLE-STRUCTURE CLAW CORING TOOL" and filed on Dec. 30, 2021, the content of which is incorporated herein by reference in its entirety.

TECHNICAL FIELD

The present invention relates to a downhole tool for oil and natural gas exploration and development, and specifically to a coring tool. The present invention further relates to a coring method using the coring tool, and to an application thereof in deep-water coring operations.

TECHNICAL BACKGROUND

In order to obtain accurate parameters of reservoir medium in reservoir formation, it is necessary to collect stratum core for analysis and research, which is referred to as "coring". Coring is usually carried out with the aid of coring tools, and the quality of the core obtained will directly affect exploration and development decisions as well as production assessment.

As the land-based oil and natural gas resources are gradually decreasing, deep-water oil development becomes an important option. For deep-water coring operation, the vessel floats up and down along with the surging waves, because the floating drilling rig is in a floating state. In this case, coring tools are prone to perform accidental core cutting operations, thus failing to form core column.

Moreover, the lithology of stratum is unknown due to lack of existing drilling data in the deep-water exploration area. As a result, appropriate coring tools cannot be selected, which further reduces the success rate of forming core column.

SUMMARY OF THE INVENTION

Aiming to solve some or all of the above technical problems in the prior arts, the present invention proposes a coring tool, which is able to avoid accidental core cutting operations, and is applicable to different types of formation, including soft formation and hard formation.

According to a first aspect of the present invention, a coring tool is proposed, which comprises a housing, a differential device for selective force transmission and a core gripping device for core cutting operations arranged within the housing, and a coring bit connected to a lower end of the housing, wherein the differential device comprises a differential unit, and a suspension unit arranged downstream of the differential unit, and the core gripping device comprises a first core gripper, a second core gripper, and a shielding mechanism. When the coring tool is in a first state, the coring bit is configured to perform coring operation, while the second core gripper is shielded by the shielding mechanism. When the coring tool is in a second state, the first core gripper is configured to move downwardly responsive to a downward pressure from the differential device, thereby performing a first core cutting operation. When the coring tool is in a third state, the shielding mechanism is configured to expose the second core gripper responsive to an upward pulling force from the differential device, thereby performing a second core cutting operation. The suspension unit comprises a first pressure-building mechanism, and a first positioning mechanism arranged downstream of the first pressure-building mechanism, the first positioning mechanism comprising an outer positioning member, an inner positioning member, and a first actuating member arranged therebetween, and a lower end of the first actuating member being fixedly connected to the shielding mechanism. In the first state, the first actuating member is locked to the outer positioning member through a second locking mechanism, and the inner positioning member is connected to the outer positioning member through a second shear pin. In the second state, the first pressure-building mechanism is actuated to shear off the second shear pin, thereby pushing the inner positioning member to move downwardly to release the second locking mechanism, so that the first actuating member transfers the downward pressure to the shielding mechanism.

According to one embodiment of the present invention, the second locking mechanism comprises a second through slot within the first actuating member, and a second locking block extending through the second through slot, an outer end of the second locking block extending into a second blind slot formed in an inner surface of the outer positioning member, and a projection being formed on an outer surface of the inner positioning member, wherein in the first state, an inner end of the second locking block engages with the projection of the inner positioning member, and in the second state, the inner positioning member moves downwardly, so that the second locking block disengages from the projection, thereby releasing the first actuating member from the outer positioning member.

According to one embodiment of the present invention, the first actuating member comprises a pressure-bearing seat fixedly connected thereto, and the inner positioning member comprises a positioning cylinder abutting against the first pressure-building mechanism and a first shear ring abutting against the positioning cylinder, the first shear ring being arranged on the pressure-bearing seat via the second shear pin.

According to one embodiment of the present invention, the first pressure-building mechanism comprises a first ball seat on the outer positioning member, which has a recess portion with an increasing inner diameter, and the pressure-bearing seat is further provided with a second shear ring which is connected thereto through a third shear pin and arranged downstream of the first shear ring, the third shear pin being configured to be sheared off after the second shear pin, so that the first ball seat is allowed to move downwardly further to the recess portion, thereby forming a circulation channel for pressure relief.

According to one embodiment of the present invention, the first actuating member further comprises a flange portion, which is configured to engage with a lower step in the recess portion, thereby forming a force transferring connection between the outer positioning member and the first actuating member.

According to one embodiment of the present invention, the suspension unit further comprises a second pressure-building mechanism, which is configured to allow downhole fluid to pass through the coring tool prior to being actuated, and allow the coring tool to enter the first state after being actuated.

According to one embodiment of the present invention, the differential unit comprises a first jaw joint and a second jaw joint which are connected to each other in a moveable but non-rotatable manner, a third locking mechanism for selectively locking or releasing relative movement between the first jaw joint and the second jaw joint, and a second actuating member for actuating the third locking mechanism, wherein a lower end of the first jaw joint is fixedly connected to the outer positioning member of the suspension unit, and a lower end of the second jaw joint is fixed to an upper end of the housing.

According to one embodiment of the present invention, the third locking mechanism comprises a third through slot arranged within the second jaw joint, and a third locking block extending through the third through slot, wherein an outer end of the third locking block extends into a third blind slot formed in an inner surface of the first jaw joint, while an inner end thereof engages with the second actuating member.

According to one embodiment of the present invention, the differential unit comprises a third pressure-building mechanism, the first jaw joint and the second actuating member being connected to each other through a fourth shear pin. The third pressure-building mechanism is configured to be actuated in the third state to shear off the fourth shear pin, thereby allowing the second actuating member to move downwardly and the third locking block to move inwardly in a radial direction, so that the third locking mechanism is released, and the first jaw joint and the second jaw joint is able to move relative to each other.

According to one embodiment of the present invention, the differential unit further comprises an outer adjusting member and an inner adjusting member, wherein the outer adjusting member is arranged on an inner side of the second jaw joint, and fixedly connected to the lower end of the first jaw joint, and the inner adjusting member is arranged on and fixedly connected to an inner side of the outer adjusting member, and has a lower end thereof fixedly connected to the outer positioning member.

According to one embodiment of the present invention, the coring bit comprises an inner cavity having an inner cone portion. The first core gripper is configured to be a retractable core gripper, and the second core gripper is configured to be a slip-collar type core gripper arranged upstream of the retractable core gripper. The shielding mechanism comprises an inner sliding sleeve and an outer sliding sleeve, wherein an upper end of the inner sliding sleeve is fixedly connected to the first actuating member of the suspension unit, a lower end of the outer sliding sleeve is fixedly connected to the retractable core gripper, and the slip-collar type core gripper is arranged within a space formed between the inner sliding sleeve and the outer sliding sleeve, the inner sliding sleeve being connected to the outer sliding sleeve through a releasable first locking mechanism.

According to one embodiment of the present invention, the first locking mechanism comprises a first shear pin that connects the outer sliding sleeve and the inner sliding sleeve, a first locking block extending outwardly in a radial direction from a circumferential surface of the outer sliding sleeve, and a step formed on an inner surface of the housing, wherein the first shear pin is configured to be sheared off by the upward pulling force, and the step is configured to prevent movement of the outer sliding sleeve via engagement with the first locking block, so that the inner sliding sleeve is able to move upwardly relative to the outer sliding sleeve.

According to one embodiment of the present invention, a lower end of the inner sliding sleeve is provided with a shield cover having a decreasing outer diameter, and a fixing sleeve is connected to the lower end of the outer sliding sleeve, wherein the retractable core gripper is fixedly connected to a lower end of the fixing sleeve, and the slip-collar type core gripper is fixed to a radial inner side of the fixing sleeve and arranged on a radial outer side of the shield cover.

According to a second aspect of the present invention, a coring method performed through the above-mentioned coring tool is proposed, which comprises Step A of actuating the second pressure-building mechanism, so that the coring tool enters the first state to perform the coring operation; Step B of actuating the first pressure-building mechanism, so that the coring tool enters the second state to perform the first core cutting operation, and Step C of actuating the third pressure-building mechanism, so that the coring tool enters the third state to perform the second core cutting operation.

According to one embodiment of the present invention, in Step B, a first force provided by the first pressure-building mechanism shears off the second shear pin, pushing the inner positioning member to move downwardly to release the second locking mechanism, so that the first force is transferred to the inner sliding sleeve to push the core gripping device to move downwardly, whereby the retractable core gripper performs the first core cutting operation, while the slip-collar type core gripper is shielded by the shielding mechanism.

According to one embodiment of the present invention, in Step C, a second force provided by the third pressure-building mechanism shears off the fourth shear pin, pushing the second actuating member to move downwardly to release the third locking mechanism, so that the first jaw joint and the second jaw joint is able to move relative to each other, whereby the inner sliding sleeve is able to move upwardly relative to the outer sliding sleeve by pulling the first jaw joint upwardly, in order to expose the slip-collar type core gripper to perform the second core cutting operation.

According to one embodiment of the present invention, Step B further comprises shearing off the third shear pin by continuous pressure building-up, so that the first pressure-building mechanism further moves downwardly to form a circulation channel for pressure relief and perform pressure relief operation.

According to a third aspect of the present invention, use of the above-mentioned coring tool or the coring method in deep-water coring operation is proposed.

BRIEF DESCRIPTION OF THE DRAWINGS

In the following the preferred embodiments of the present invention will be described in detail with reference to the accompanying drawings. In the drawings.

In the drawings, the same reference numerals are used to indicate the same components. The drawings are not necessarily drawn to actual scales.

DETAILED DESCRIPTION OF EMBODIMENTS

The present invention will be further described below with reference to the accompanying drawings. In this context, a direction toward the wellhead is defined as "above", "upstream", "upper end", or the like, while a direction away from the wellhead is defined as "below", "downstream", "lower end", or the like. Further, a direction along a length of the coring tool is defined as "longitudinal" or "axial", while a direction perpendicular thereto is defined as "radial", wherein a direction in the radial direction towards the formation is defined as "radially outward", while a direction away from the formation is defined as "radially inward".

Figure 1:
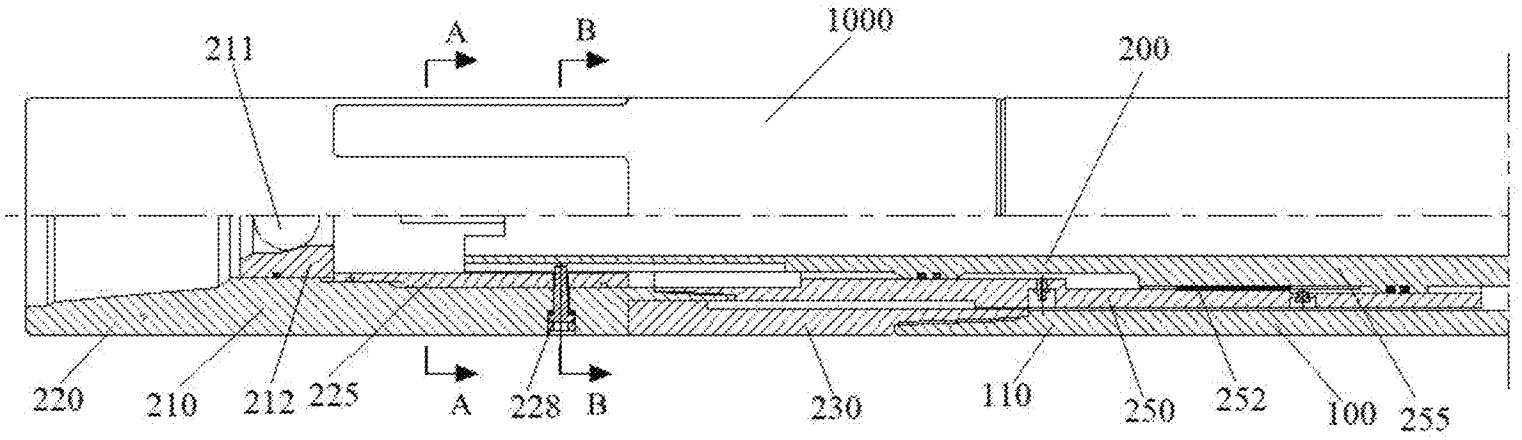
FIG. 1 is a partial sectional view schematically showing a structure of a first part of a coring tool according to the present invention.
Figure 2:
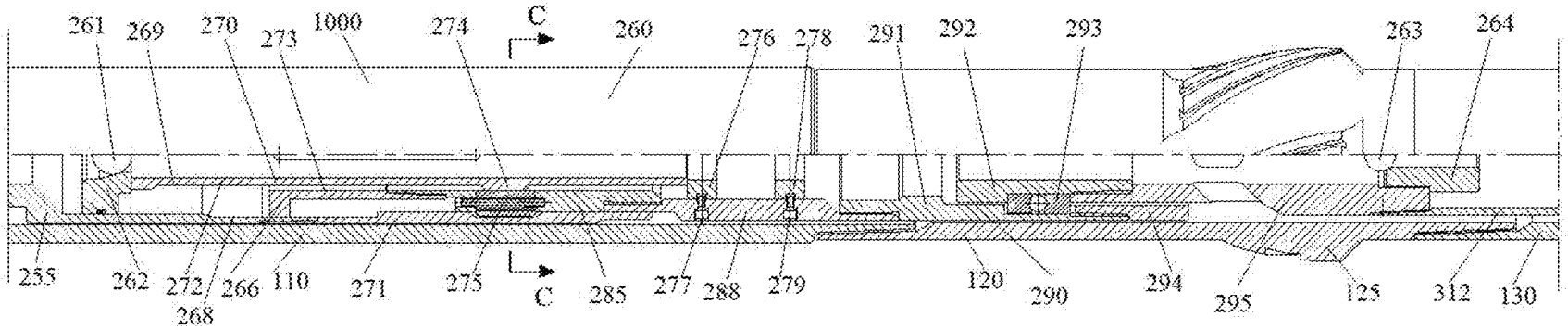
FIG. 2 is a partial sectional view schematically showing a structure of a second part of the coring tool according to the present invention.
Figure 3:
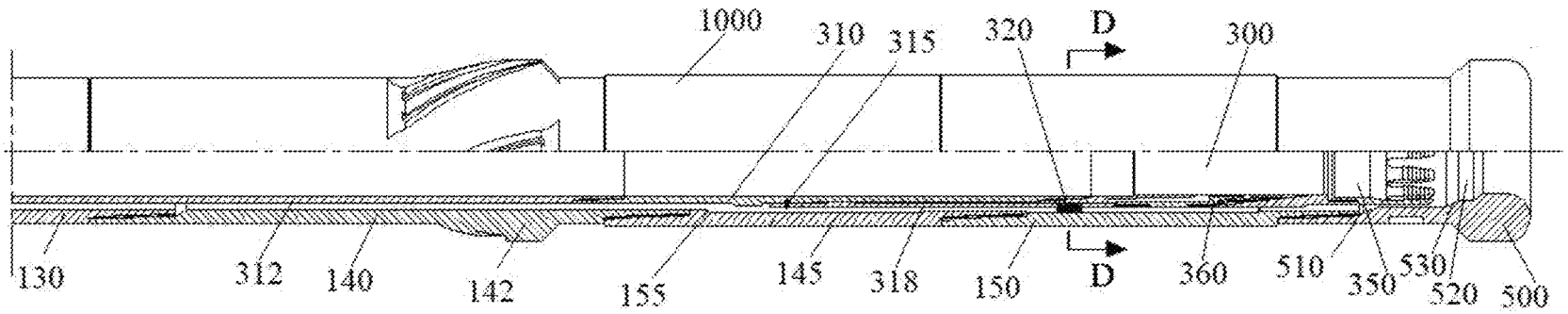
FIG. 3 is a partial sectional view schematically showing a structure of a third part of the coring tool according to the present invention.

FIGS. 1 to 3 show an overall structure of a coring tool 1000 according to the present invention, wherein FIGS. 1 to 3 schematically show structures of a first part, a second part and a third part of the coring tool 1000 along the longitudinal direction from top to bottom, respectively. It is readily understood that the first, second and third parts of the coring tool 1000 are proposed only to facilitate display and understanding, rather than implying that the coring tool 1000 is actually divided into these parts.

As shown in FIGS. 1 to 3, the coring tool 1000 according to the present invention comprises a housing 100 formed as a hollow cylinder, and a coring bit 500 connected to a lower end of the housing 100. A differential device 200 and a core gripping device 300 located downstream of the differential device 200 are arranged within the housing 100. The coring bit 500 is used for coring operation, and the differential device 200 is configured to selectively transfer force to the core gripping device 300, so that the core gripping device 300 is able to perform core cutting operation.

For convenience, the housing 100 typically consists of a number of cylindrical segments that are fixed together (e.g., through threads). According to the present invention, as shown in FIGS. 1 to 3, the housing 100 comprises a first housing portion 110, a second housing portion 120, a third housing portion 130, a fourth housing portion 140, a fifth housing portion 145, and a sixth housing portion 150, which are sequentially connected together through threads, wherein the coring bit 500 is connected to the sixth housing portion 150. It would be readily understood that the specific number and position of the housing portions may be easily selected according to actual needs.

In addition, as shown in FIGS. 2 and 3, a first centralizer 125 and a second centralizer 142 are arranged on outer surfaces of the second housing portion 120 and the fourth housing portion 140, respectively. The structure and function of the centralizer are well known in the art, which will not be illustrated in detail herein.

As shown in FIG. 3, the coring bit 500 comprises a bit body 510, with blades (not shown) for cutting formation arranged at a front end thereof. The bit body 510 comprises a hollow inner cavity 520, through which the cut core enters the coring tool 1000 for subsequent core cutting operations. According to the present invention, the bit body 510 of the coring bit 500 has an inner cone portion 530 with a decreasing inner diameter in a direction from top to bottom. This type of coring bit is well known in the art, which will not be illustrated in detail herein.

The core gripping device 300 comprises a retractable core gripper 350 and a slip-collar type core gripper 360, wherein the retractable core gripper 350 is arranged within the inner cavity 520 of the coring bit 500 to perform a first core cutting operation on the cut core. Specifically, the retractable core gripper 350 moves downwardly under a corresponding force, and retract radially inwardly under an impact of the inner cone portion 530 of the coring bit 500, thereby cutting the core and completing the first core cutting operation. The retractable core gripper 350 may be, for example, a split-type retractable core gripper. The slip-collar type core gripper 360 is provided within the housing 100 and located upstream of the retractable core gripper 350, for performing a second core cutting operation on the cut core. The structures and functions of the retractable core gripper 350 and the slip-collar type core gripper 360 are known to one skilled in the art, which will not be illustrated in detail herein.

It is readily appreciated by one skilled in the art that, by selecting the appropriate inner diameter of the retractable core gripper 350, it can be ensured that the retractable core gripper 350 will not (or at least will substantially not) come into contact with the cut core entering the inner cavity 520 of the coring bit 500 during the coring operation, thus avoiding accidental core cutting operations.

According to the present invention, the core gripping device 300 further comprises a shielding mechanism 310, which is configured to be in a shielding state during both the coring operation and the first core cutting operation, so as to prevent the slip-collar type core gripper 360 from coming into contact with the cut core entering the coring tool 1000, and to be in an open state during the second core cutting operation, in order to expose the slip-collar type core gripper 360 for performing the second core cutting operation. By providing the shielding mechanism 310, the slip-collar type core gripper 360 does not come into contact with the cut core during both the coring operation and the first core cutting operation.

Since the floating drilling rig is in a floating state, the vessel floats up and down along with the surging waves, especially when it comes to deep-water coring operations. In this case, repeated core cutting operations are likely to occur. As a result, the core cannot be formed into column. By providing the shielding mechanism 310, however, the coring tool 1000 according to the present invention is able to ensure that the slip-collar type core gripper 360 is shielded until the second core cutting operation is performed, thus effectively avoiding accidental core cutting operations. In addition, by selecting the appropriate inner diameter of the retractable core gripper 350, it can also be ensured that the retractable core gripper 350 does not come into contact with the core during the coring operation, thus effectively avoiding accidental core cutting operations caused by the retractable core gripper 350. Therefore, the coring tool 1000 according to the present invention is capable of avoiding accidental core cutting operations and thus significantly improving the success rate of forming core column.

Meanwhile, according to the present invention, the core gripping device 300 of the coring tool 1000 comprises the retractable core gripper 350 and the slip-collar type core gripper 360, wherein the retractable core gripper 350 performs the first core cutting operation first, and the slip-collar type core gripper 360 then performs the second core cutting operation. It is known that the retractable core gripper 350 is suitable for soft formations, while the slip-collar type core gripper 360 is suitable for hard formations. The coring tool 1000 according to the present invention is particularly suitable for formations with unknown lithology. If the core is taken from the soft formation, both the retractable core gripper 350 and the slip-collar type core gripper 360 can perform respective core cutting operations smoothly. If the core is taken from the hard formation, the retractable core gripper 350 may not be able to perform the first core cutting operation successfully, but the slip-collar type core gripper 360 is still able to perform the second core cutting operation, thereby completing the core cutting operation. Therefore, the coring tool 1000 according to the present invention can be used in various formations to successfully complete the core cutting operation.

Figure 4:
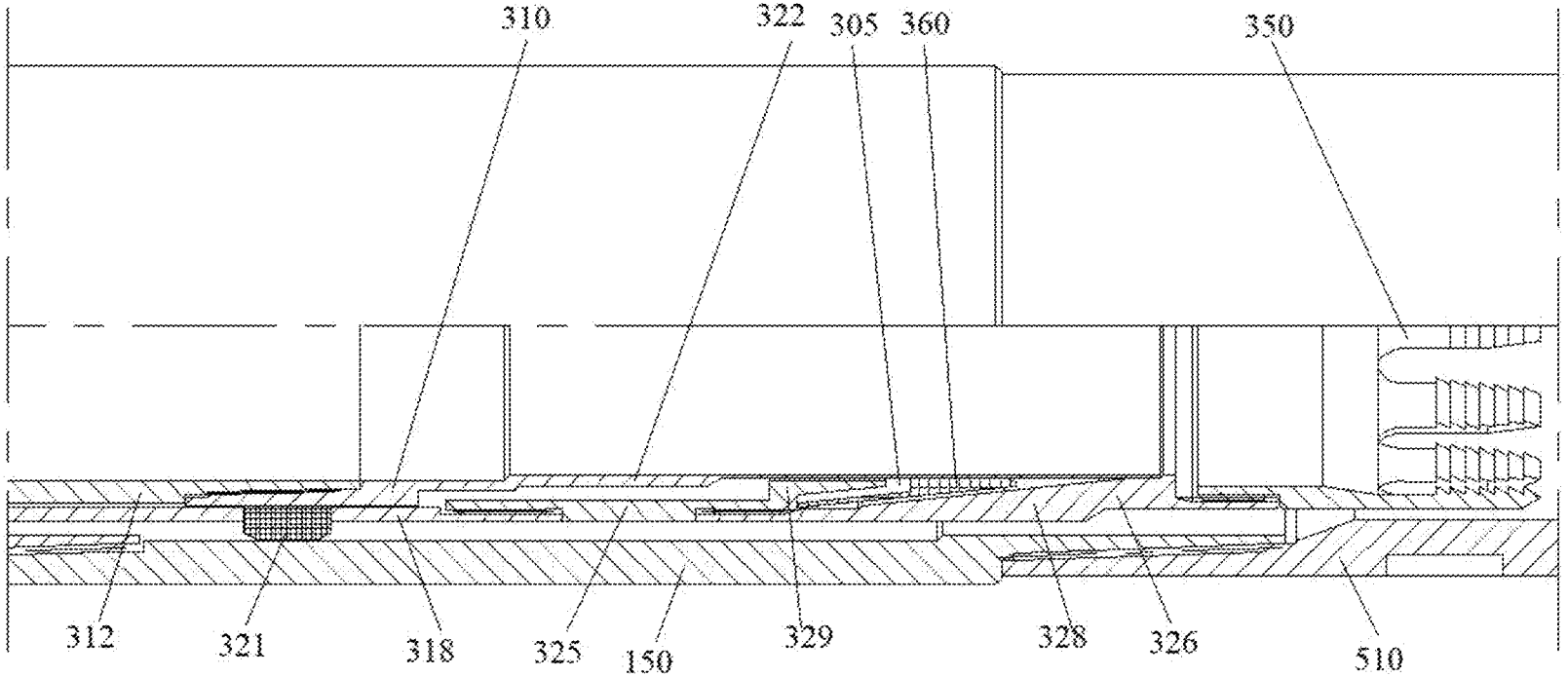
FIG. 4 is a partial enlargement view of FIG. 3, showing a detailed structure of a shielding mechanism.

FIG. 4 is a partial enlargement view taken from FIG. 3, showing a detailed structure of the shielding mechanism 310. As shown in FIG. 4, the shielding mechanism 310 comprises an outer sliding sleeve 318 within the housing 100, and an inner sliding sleeve 312 within the outer sliding sleeve 318. The inner sliding sleeve 312 and the outer sliding sleeve 318 extend within a range of the housing 100 from the third housing portion 130 to the sixth housing portion 150. An upper end of the inner sliding sleeve 312 is fixedly connected to the differential device 200, while a lower end of the outer sliding sleeve 318 is fixedly connected to the retractable core gripper 350. The inner sliding sleeve 312 is radially spaced apart from the outer sliding sleeve 318, so as to form a space 305 for accommodating the slip-collar type core gripper 360, which is fixed on the outer sliding sleeve 318.

According to the present invention, the inner sliding sleeve 312 and the outer sliding sleeve 318 are connected to each other through a releasable first locking mechanism 320. The first locking mechanism locks the inner sliding sleeve 312 and the outer sliding sleeve 318 together during the coring operation and the first core cutting operation, and releases them during the second core cutting operation, so that the inner sliding sleeve 312 is able to move relative to the outer sliding sleeve 318. In this manner, under an upward pulling force exerted on the differential device 200, the inner sliding sleeve 312 moves upwardly relative to the outer sliding sleeve 318, in order to expose the slip-collar type core gripper 360 for performing the second core cutting operation.

Figure 8:
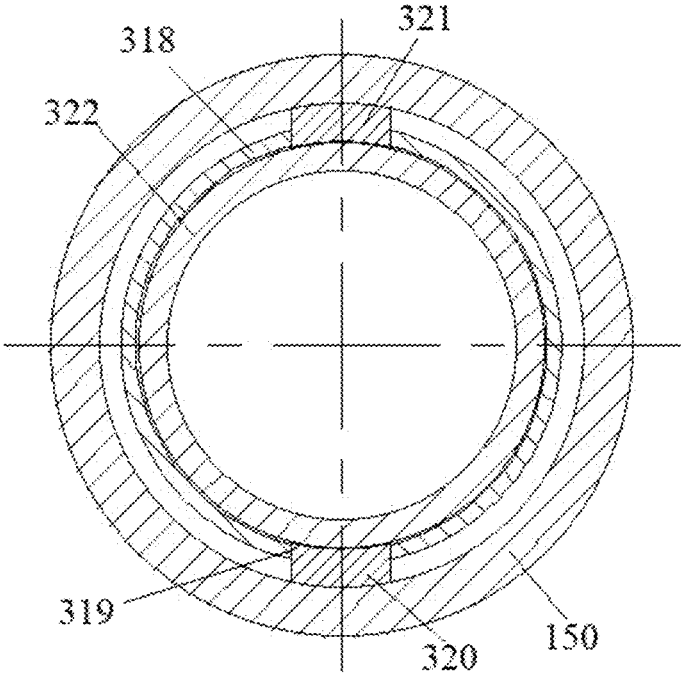
FIG. 8 is a sectional view along arrow D-D in FIG. 3, showing a detailed structure of a first locking mechanism.

Specifically, the first locking mechanism 320 includes a first shear pin 315 (see FIG. 3) that connects the inner sliding sleeve 312 and the outer sliding sleeve 318 to each other, and a first locking block 321. FIG. 8 is a sectional view along arrow D-D in FIG. 3. As shown in FIG. 8, the first locking block 321 is arranged in a first through slot 319 formed within a circumferential surface of the outer sliding sleeve 318. An inner end surface of the first locking block 321 engages with the inner sliding sleeve 312 (specifically, a shield cover 322 fixedly attached to a lower end of the inner sliding sleeve 312, as described below), and an outer end surface thereof engages with the housing 100 (specifically, the sixth housing portion 150 of the housing 100). Meanwhile, the first locking mechanism 320 further comprises a step 155 (see FIG. 3) formed on an inner surface of the sixth housing portion 150. When the inner sliding sleeve 312 and the outer sliding sleeve 318 move upwardly together, the step 155 is able to engage with the first locking block 321, thereby preventing further movement of the outer sliding sleeve 318. As a result, the inner sliding sleeve 312 can move upwardly relative to the outer sliding sleeve 318.

During the second core cutting operation, the first shear pin 315 is sheared off by applying an upward pulling force to the core gripping device 300 via the differential device 200. In this case, the first locking mechanism 320 is still in a locked state. Therefore, the upward pulling force pulls the inner sliding sleeve 312 and the outer sliding sleeve 318 upwardly together, until the first locking block 321 engages with the step 155. Then, the outer sliding sleeve 318 stops moving, while the inner sliding sleeve 312 continues to move upwardly, so as to expose the slip-collar type core gripper 360.

It is readily understood that in an embodiment not shown, the first locking block 321 may be formed integrally with the outer sliding sleeve 318.

In an embodiment shown in FIG. 4, the lower end of the inner sliding sleeve 312 is provided with a shield cover 322 having a decreasing outer diameter, and the lower end of the outer sliding sleeve 318 is provided with a fixing sleeve 328, which may comprise a first fixing member 325 fixedly connected to the lower end of the outer sliding sleeve 318, and a second fixing member 326 fixedly connected to the retractable core gripper 350. The first fixing member 325 and the second fixing member 326 are fixedly connected to each other through threads. In this manner, the slip-collar type core gripper 360, which is fixed at the second fixing member 326 and located between the shield cover 322 and the second fixing member 326, is blocked by the shield cover 322 and not in contact with the core.

As shown in FIG. 4, in this embodiment, the first fixing member 325 may also comprise a shoulder 329 that extends inwardly along the radial direction, and downwardly in the axial direction, thereby shielding the slip-collar type core gripper 360 more conveniently.

According to the present invention, the differential device 200 comprises a differential unit 210 and a suspension unit 260. FIG. 2 schematically shows a structure of the suspension unit 260. As shown in FIG. 2, the suspension unit 260 is arranged substantially within the first housing portion 110, the second housing portion 120 and the third housing portion 130 of the housing 100. The suspension unit 260 comprises a first pressure-building mechanism 261 having a first ball seat 262 that can be blocked by a ball. A first positioning mechanism 270 is provided downstream of the first pressure-building mechanism 261, and comprises an outer positioning member 271 arranged within the first housing portion 110 of the housing 100, and an inner positioning member 272 arranged within the outer positioning member 271. Both the outer positioning member 271 and the inner positioning member 272 may be a hollow cylinder.

A first actuating member 273 is provided between the outer positioning member 271 and the inner positioning member 272. A lower end of the first actuating member 273 is fixedly connected to the inner sliding sleeve 312. Specifically, in the embodiment as shown in the drawings, the first actuating member 273 is fixedly connected to a positioning joint 285, which is fixedly connected to a pressure-bearing seat 288. In terms of force transfer connection, both the positioning joint 285 and the pressure-bearing seat 288 may be regarded as part of the first actuating member 273. The pressure-bearing seat 288 is fixedly connected to a bearing unit 290, which is fixedly connected to the inner sliding sleeve 312 via a diversion joint 295. The bearing unit 290 comprises a bearing cartridge 291 fixedly connected to the pressure-bearing seat 288, a suspended shaft 292, a bearing 293, and a bearing support 294 fixedly connected to the diversion joint 295. The structures of the bearing unit 290 and the diversion joint 295 are known to one skilled in the art, which will not be illustrated in detail herein.

According to the present invention, the first actuating member 273 is locked to the outer positioning member 271 through a releasable second locking mechanism 275, and the inner positioning member 273 is fixed to the outer positioning member 271 through a second shear pin 277. During the first core cutting operation of the coring tool 1000, the first ball seat 262 of the first pressure-building mechanism 261 is blocked by a ball to build up pressure, which will shear off the second shear pin 277. At this time, the first ball seat 262 moves downwardly, pushing the inner positioning member 272 downwardly to release the second locking mechanism 275, so that the first actuating member 273 disengages with the outer positioning member 271. In this manner, the pressure of the first pressure-building mechanism 261 can be transmitted downwardly to the inner sliding sleeve 312 through the inner positioning member 272, a second shear ring 278, and the pressure-bearing seat 288. This pressure, together with the gravity of corresponding parts of the suspension unit 260, is applied to the core gripping device 300, so that the retractable core gripper 350 is pushed to move downwardly, and then retract inwardly along the radial direction under the impact of the inner cone portion 530 of the coring bit 500, thereby performing the first core cutting operation.

Figure 7:
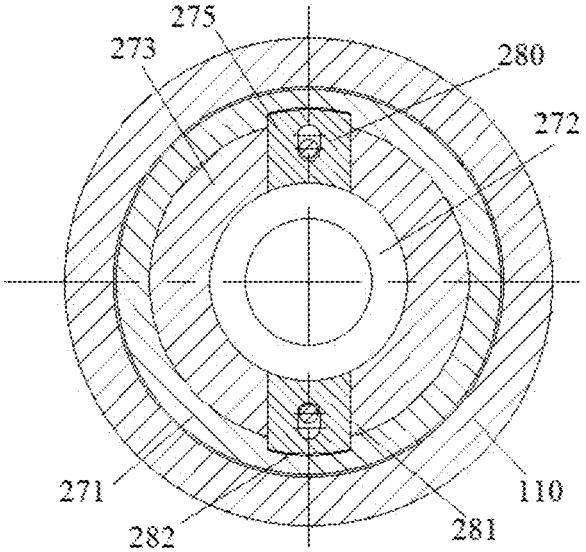
FIG. 7 is a sectional view along arrow C-C in FIG. 2, showing a detailed structure of a second locking mechanism.

FIG. 7 is a sectional view along arrow C-C in FIG. 3. As shown in FIG. 7, the second locking mechanism 275 comprises a second through slot 281 within the first actuating member 273, and a second locking block 280 extending through the second through slot 281. An outer end of the second locking block extends into a second blind slot 282 formed in an inner surface of the outer positioning member 271. The second locking mechanism 275 further comprises a projection 274 formed on an outer surface of the inner positioning member 272. When the coring tool 1000 is in the first state (at which time the coring operation is performed), an inner end of the second locking block 280 engages with the projection 274 of the inner positioning member 272. In this manner, under the impact of the second shear pin 277 and the second locking block 280, the outer positioning member 271, the inner positioning member 272 and the first actuating member 273 are fixed to each other without relative movements.

When the coring tool 1000 is in the second state (at which time the first core cutting operation is performed), the pressure formed by the first pressure-building mechanism 261 shears off the second shear pin 277. At this time, the first ball seat 262 moves downwardly to push the inner positioning member 272 downwardly. In this case, the second locking block 280 disengages from the projection 274 of the inner positioning member 272, and thus is able to slide inwardly in the radial direction, in order to release the second locking mechanism 275. At this time, the first actuating member 273 and the outer positioning member 271 disengage from each other.

It is readily understood that in order to facilitate the sliding of the second locking block 280 inwardly in a radial direction, the lower ends of the second locking block 280 and the second blind slot 282 each have an inclined surface. In this manner, once the second locking block 280 is not blocked by the projection 274 of the inner positioning member 272, the second locking block 280 is able to move both downwardly in the axial direction and inwardly in the radial direction under its gravity, in order to release the second locking mechanism 275.

As described above, the lower end of the first actuating member 273 is fixedly connected to the pressure-bearing seat 288. The inner positioning member 272 comprises a first positioning cylinder 269 which is arranged downstream of the first pressure-building mechanism 261 and axially abuts against the first ball seat 262, and a first shear ring 276 axially abutting against the first positioning cylinder 269. The first shear ring 276 is connected to the pressure-bearing seat 288 through the second shear pin 277. The pressure-bearing seat 288 is further provided with the second shear ring 278 which is arranged downstream of the first shear ring 276 and connected to the pressure-bearing seat 288 through a third shear pin 279. After the second shear pin 277 is sheared off, the first ball seat 262, the first positioning cylinder 269 and the first shear ring 276 are together pushed to move downwardly by the pressure, until the first shear ring 276 is in contact with the second shear ring 278. At this time, the pressure of the first pressure-building mechanism 261 can be transmitted downwardly to the inner sliding sleeve 312 through the first ball seat 262, the first positioning cylinder 269, the first shear ring 276, the second shear ring 278 and the pressure-bearing seat 288.

In addition, a recess portion 268 with an increasing inner diameter is formed on the inner surface of the outer positioning member 271, and comprises two inwardly extending steps spaced apart in the axial direction. It should be noted that although the recess portion 268 as shown in FIG. 2 is formed on an inner surface of an inner adjusting member 255 (as described below), the inner adjusting member 255 and the outer positioning member 271 are fixedly connected to each other, which may be regarded as a whole.

After the first core cutting operation is completed, the third shear pin 279 is also sheared off with the increasing pressure provided by the first pressure-building mechanism 261, so that the first ball seat 262 continues to move to the recess portion 268 of the outer positioning member 271. Since an outer diameter of the recess portion 268 of the outer positioning member 271 is larger than that of the first ball seat 262, a circulation channel for pressure relief is formed. At this time, a pressure relief operation can be performed as a preparation step for the second core cutting operation thereafter.

Furthermore, according to the present invention, the first actuating member 273 has a flange 266, which is configured to engage with the lower step in the recess portion 268 of the outer positioning member 271 when the outer positioning member 271 is pulled upwardly, thereby forming a force transferring connection between the outer positioning member 271 and the first actuating member 273. The function of this structure will be described below in detail.

As shown in FIG. 1, the differential unit 210 comprises a first jaw joint 220 and a second jaw joint 230. A lower end of the second jaw joint 230 is fixedly connected to an upper end of the first housing portion 110 of the housing 100. The first jaw joint 220 is arranged upstream of the second jaw joint 230, with an upper end thereof configured to connect to an upstream drill tool (not shown). A lower end of the first jaw joint 220 is fixedly connected to the outer positioning member 271 of the suspension unit 260, which will be described below in more detail. The first jaw joint 220 and the second jaw joint 230 can be attached to each other in a well-known manner like jaw clutch engagement, so that they cannot rotate but move relative to each other in the axial direction.

The differential unit 210 further comprises a third locking mechanism 240 (see FIG. 5) and a second actuating member 225. When the coring tool 1000 is in the first state and the second state, the third locking mechanism 240 is in a locked state, so that the first jaw joint 220 and the second jaw joint 230 cannot move relative to each other. When the coring tool 1000 is in a third state (at which time the second core cutting operation is performed), the second actuating member 225 may actuate the third locking mechanism 240 from the locked state into a released state, so that the first jaw joint 220 can move relative to the second jaw joint 230.

Figure 5:
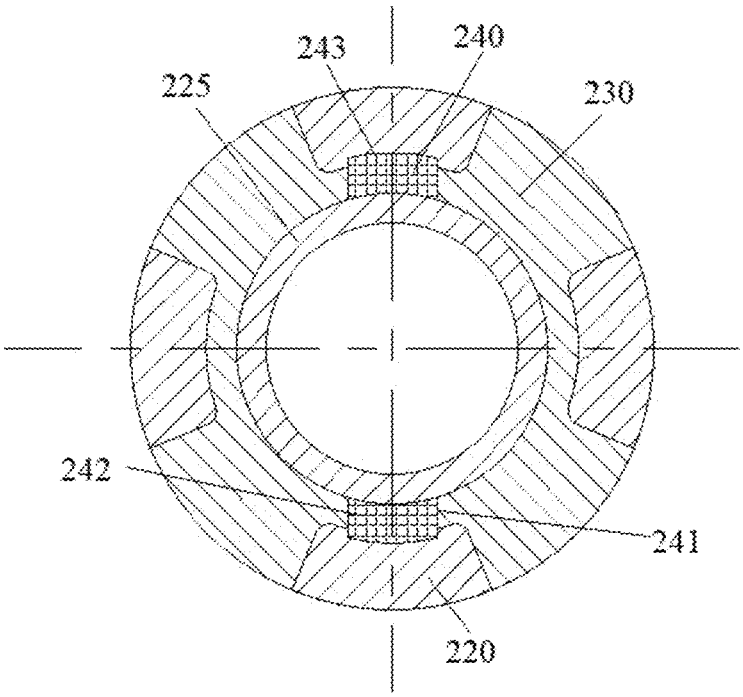
FIG. 5 is a sectional view along arrow A-A in FIG. 1, showing a detailed structure of a third locking mechanism.

FIG. 5 is a sectional view along arrow A-A in FIG. 1. As shown in FIG. 5, the third locking mechanism 240 comprises a third locking block 242 within a third through slot 241 formed in the second jaw joint 230. An outer end of the third locking block 242 extends into a third blind slot 243 formed in an inner surface of the first jaw joint 220, while an inner end thereof engages with the second actuating member 225.

Figure 6:
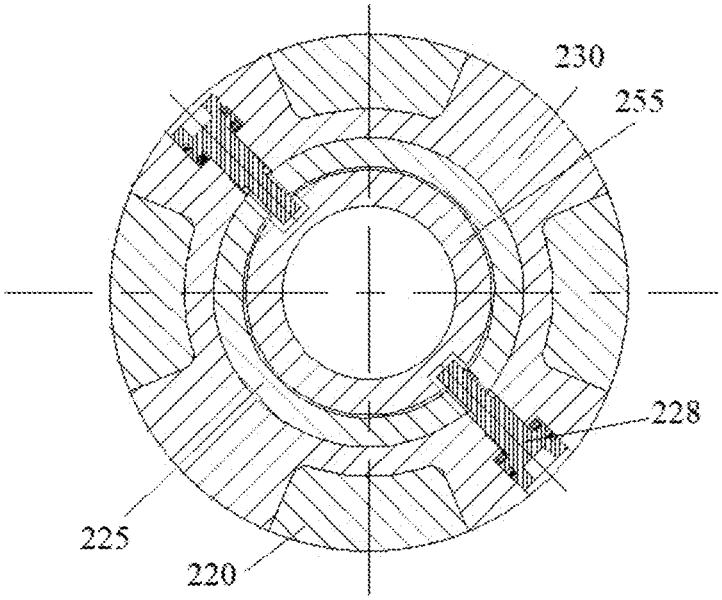
FIG. 6 is a sectional view along arrow B-B in FIG. 1, showing a detailed structure of a fourth shear pin.

The differential unit 210 further comprises a third pressure-building mechanism 211 with a third ball seat 212 that can be blocked by a ball. The third ball seat 212 is configured to abut against the second actuating member 225 in the axial direction. The second actuating member 225 is connected to the first jaw joint 220 through a fourth shear pin 228, as shown in FIGS. 1 and 6. FIG. 6 is a sectional view along arrow B-B in FIG. 1.

Thus, when the coring tool 1000 is in the third state, the pressure formed by the third pressure-building mechanism 211 when the third ball seat 212 is blocked by a ball shears off the fourth shear pin 228. In this case, the third ball seat 212 pushes the second actuating member 225 to move downwardly under the pressure, releasing the block on the third locking block 242. In this manner, the third locking block 242 moves inwardly in a radial direction, so that the third locking mechanism 240 enters the released state from the locked state, thus allowing the first jaw joint 220 to move relative to the second jaw joint 230. Subsequently, the outer positioning member 271 of the suspension unit 260 can be pulled upwardly by lifting up the first jaw joint 220. This upward pulling force is transmitted downwardly to the inner sliding sleeve 312 through the force transferring connection between the outer positioning member 271 and the first actuating member 273. Thus, as described above, the first locking mechanism 320 is released when the inner sliding sleeve 312 moves upwardly relative to the outer sliding sleeve 318, so that the slip-collar type core gripper 360 is exposed inwardly in the radial direction, resulting in that the second core cutting operation can be performed.

It is readily understood that the lower ends of the third locking block 242 and the third blind slot 243 each have an inclined surface, in order to facilitate the sliding of the third locking block 242 inwardly in the radial direction. In this manner, once the third locking block 242 is not blocked by the second actuating member 225, it is able to move both downwardly in the axial direction and inwardly in the radial direction under its gravity, in order to release the third locking mechanism 240.

According to an embodiment of the present invention, the differential unit 210 further comprises an outer adjusting member 250 and the inner adjusting member 255. As shown in FIG. 1, the outer adjusting member 250 is arranged on an inner side of the second jaw joint 230 and the first housing portion 110, and fixedly connected to the lower end of the first jaw joint 220. The inner adjusting member 255 is arranged on an inner side of the outer adjusting member 250, and fixedly connected to the outer adjusting member 250 through a thread 252. An upper end of the inner adjusting member 255 abuts against the third ball seat 212 of the third pressure-building mechanism 211, while a lower end thereof is fixedly connected to an upper end of the outer positioning member 271 of the suspension unit 260.

In an initial state of the coring tool 1000, as shown in FIG. 6, the fourth shear pin 228 passes through the first jaw joint 220 and the second actuating member 225 to push against the inner adjusting member 255. Therefore, the first jaw joint 220, the second actuating member 225 and the inner adjusting member 255 remain stationary relative to each other. In this case, since the outer adjusting member 250 is fixedly connected to the first jaw joint 220 and thus remains stationary, and the inner adjusting member 255 is connected to the outer adjusting member 250 through threads, it is possible to rotate the inner adjusting member 255 by moderately loosening the fourth shear pin 228, so that the inner adjusting member 255 is able to move axially relative to the outer adjusting member 250. Since the inner adjusting member 255 is connected to the core gripping device 300 by means of force transferring connection, the axial movement of the inner adjusting member 255 relative to the outer adjusting member 250 can adjust the axial position of the core gripping device 300, thereby adjusting an axial distance of the retractable core gripper 350 relative to the coring bit 500. In this manner, it is possible to adjust the position of the first core cutting operation (and the second core cutting operation) in different situations.

When the coring tool 1000 is in the third state, the pressure provided by the third pressure-building mechanism 211 shears off the fourth shear pin 228. In this case, the third locking mechanism 240 enters the released state as described above, thereby allowing the first jaw joint 210 to move relative to the second jaw joint 230. Afterwards, when the first jaw joint 210 is lifted up, the lifting force is transmitted to the outer positioning member 271 of the suspension unit 260 through the outer adjusting member 250 and the inner adjusting member 255 in turn, and then transmitted to the inner sliding sleeve 312 of the core gripping device 300 through the first actuating member 273 of the suspension unit 260 and the bearing unit 290, so as to pull the inner sliding sleeve 312 upwardly relative to the outer sliding sleeve 318. As a result, the slip-collar type core gripper 360 can be exposed inwardly in the radial direction to perform the second core cutting operation.

According to another aspect of the present invention, a coring method for performing coring operation using said coring tool 1000 is further proposed. The coring method mainly includes the following steps.

First, the coring tool 1000 according to the present invention is lowered into the bottom of a well.

Afterwards, a second ball seat 264 of a second pressure-building mechanism 263 is blocked by a ball. At this time, the coring tool 1000 is in the first state to perform the coring operation.

After the coring operation is completed, the first ball seat 262 of the first pressure-building mechanism 261 is blocked by a ball. In this case, the coring tool 1000 enters the second state to perform the first core cutting operation. The first pressure provided by the first pressure-building mechanism 261 shears off the second shear pin 277, so that the first ball seat 262 moves downwardly, pushing the inner positioning member 272 downwardly to release the second locking mechanism 275. Thus, the first actuating member 273 and the outer positioning member 271 disengage from each other. In this case, the first pressure of the first pressure-building mechanism 261 is transmitted to the inner sliding sleeve 312 of the core gripping device 300 via the inner positioning member 272, the second shear ring 278, the pressure-bearing seat 288 and the bearing unit 290. The first pressure, together with the gravity of the corresponding parts of the suspension unit 260, is applied to the core gripping device 300 to push the retractable core gripper 350 to move downwardly. Therefore, the retractable core gripper 350 will retract inwardly in the radial direction under the impact of the inner cone portion 530 of the coring bit 500, thereby performing the first core cutting operation.

After the first core cutting operation is completed, the pressure building is continued, so that the first pressure-building mechanism 261 provides a second pressure sufficient to shear off the third shear pin 279. After the third shear pin 279 is sheared off, the first ball seat 262 continues to move downwardly into the recess portion 268 of the outer positioning member 271, so that a circulation channel for pressure relief is formed. In this case, the pressure relief operation can be performed.

After the pressure relief operation is completed, the third ball seat 212 of the third pressure-building mechanism 211 is blocked by a ball. At this time, the coring tool 1000 enters the third state to perform the second core cutting operation. The pressure provided by the third pressure-building mechanism 211 shears off the fourth shear pin 228, so that the third ball seat 212 moves downwardly, pushing the second actuating member 225 downwardly to release the third locking mechanism 240. Thus, the first jaw joint 220 is able to move relative to the second jaw joint 230. In this case, the upward pulling force applied to the first jaw joint 220 can be transmitted to the inner sliding sleeve 312 of the core gripping device 300 via the outer adjusting member 250, the inner adjusting member 255, the outer positioning member 271, the first actuating member 273 and the bearing unit 290, so that the inner sliding sleeve 312 can be pulled upwardly relative to the outer sliding sleeve 318. As a result, the slip-collar type core gripper 360 can be exposed inwardly in the radial direction to perform the second core cutting operation.

After the second core cutting operation, a column core is formed within the inner sliding sleeve 312 of the core gripping device 300. In this case, the coring tool 1000 can be removed for subsequent processing and analysis of the core.

In the method described above, neither the slip-collar type core gripper 360 nor the retractable core gripper 350 of the core gripping device 300 will contact the core cut by the coring bit 500 during the coring operation. During the first core cutting operation and the pressure relief operation, the slip-collar type core gripper 360 of the core gripping device 300 do not contact the core cut by the coring bit 500, either. Therefore, repeated accidental core cutting operations can be avoided to the greatest extent possible, and the success rate of core column formation can be significantly improved. Meanwhile, the two core cutting operations performed by the retractable core gripper 350 and the slip-collar type core gripper 360 of the core gripping device 300 can be completed smoothly in both soft and hard formations.

A cleaning operation may also be performed prior to the coring operation, according to the coring method of the present invention. Specifically, a pump is turned on to circulate mud prior to the coring operation, at which time the mud enters the coring bit 500 through internal channels of the coring tool 1000 (e.g., inner holes of the inner adjusting member 255, inner holes of the first positioning cylinder 269, inner holes of the pressure-bearing seat 288, and inner holes of the inner sliding sleeve 213, etc.), thereby entering an annular space between the coring tool 1000 and the well wall. With the cleaning operation, both the bottom of the well and the inner sliding sleeve 213 temporarily storing the core in subsequent operations can be cleaned. Thus, the coring method according to the present invention can realize multi-cylinder continuous coring with a high degree of reliability.

During deep-water coring operations, fluctuations of floating drilling rigs may lead to repeated coring, and lithology of the exploration area is usually unknown. The coring tool and the coring method according to the present invention are capable of avoiding repeated coring by means of a hidden core gripping device, and at the same time, are applicable to different types of formations, including soft and hard formations. Therefore, the coring tool and the coring method according to the present invention are particularly suitable for deep-water coring operations.

In the context of the present invention, the ordinal numbers "first", "second" or the like before the parts are only for distinguishing the same parts, rather than implying any order of precedence, unless otherwise specified.

In the context of the present invention, the expression "part A is provided within part B" means that at least a portion of part A is provided within part B, and it is not required that all components of part A are provided within part B.

Furthermore, in the context of the present invention, a number of parts fixedly connected (or connected through force-transferring) together may be used as a whole to transmit forces, and thus may also be considered as a single component. Although only threaded connection is described herein as an example of fixed connection, it would be readily understood by one skilled in the art that other means of fixed connection are also applicable to the present invention.

Although the present invention has been described in detail with reference to the above exemplary embodiments, one skilled in the art may make various modifications of the embodiments, and substitute the parts herein with equivalence without departing from the scope of the present invention. In particular, the technical features in all the embodiments may be combined in any manner if there is no structural conflict. The present invention is not limited to the specific embodiments disclosed herein, and shall include all technical solutions falling within the scope of the claims of the present invention.

The invention claimed is:

1. A coring tool (1000), comprising a housing (100), a differential device (200) for selective force transmission and a core gripping device (300) for core cutting operations both arranged within the housing (100), and a coring bit (500) connected to a lower end of the housing (100), wherein the differential device (200) comprises a differential unit (210), and a suspension unit (260) arranged downstream of the differential unit (210), and the core gripping device (300) comprises a first core gripper (350), a second core gripper (360), and a shielding mechanism (310);

when the coring tool is in a first state, the coring bit (500) is configured to perform coring operation, while the second core gripper (360) is shielded by the shielding mechanism (310);

when the coring tool is in a second state, the first core gripper (350) is configured to move downwardly in response to a downward pressure from the differential device (200), thereby performing a first core cutting operation;

when the coring tool is in a third state, the shielding mechanism (310) is configured to expose the second core gripper (360) in response to an upward pulling force from the differential device (200), thereby performing a second core cutting operation; and the suspension unit (260) comprises a first pressure-building mechanism (261), and a first positioning mechanism (270) arranged downstream of the first pressure-building mechanism (261), the first positioning mechanism comprising an outer positioning member (271), an inner positioning member (272), and a first actuating member (273) arranged therebetween, and a lower end of the first actuating member (273) being fixedly connected to the shielding mechanism (310);

wherein in the first state, the first actuating member (273) is locked to the outer positioning member (271) through a second locking mechanism (275), and the inner positioning member (272) is connected to the outer positioning member (271) through a second shear pin (277); and in the second state, the first pressure-building mechanism (261) is actuated to shear off the second shear pin (277), thereby pushing the inner positioning member (272) to move downwardly to release the second locking mechanism (275), so that the first actuating member (273) transfers the downward pressure to the shielding mechanism (310).

2. The coring tool according to claim 1, wherein the second locking mechanism (275) comprises a second through slot (281) within the first actuating member (273), and a second locking block (280) extending through the second through slot (281), an outer end of the second locking block (280) extending into a second blind slot (282) formed in an inner surface of the outer positioning member (271), and a projection (274) formed on an outer surface of the inner positioning member (272), wherein in the first state, an inner end of the second locking block engages with the projection (274) of the inner positioning member (272), and in the second state, the inner positioning member (272) moves downwardly, so that the second locking block (280) disengages from the projection (274), thereby releasing the first actuating member (273) from the outer positioning member (271).

3. The coring tool according to claim 2, wherein the first actuating member (273) comprises a pressure-bearing seat (288) fixedly connected thereto, and the inner positioning member (272) comprises a positioning cylinder (269) abutting against the first pressure-building mechanism (261) and a first shear ring (276) abutting against the positioning cylinder (269), the first shear ring (276) being arranged on the pressure-bearing seat (288) via the second shear pin (277).

4. The coring tool according to claim 3, wherein the first pressure-building mechanism (261) comprises a first ball seat (262) arranged on the outer positioning member (271), which has a recess portion (268) with an increasing inner diameter, and the pressure-bearing seat (288) is further provided with a second shear ring (278) connected thereto through a third shear pin (279) and arranged downstream of the first shear ring (276), the third shear pin (279) being configured to be sheared off after the second shear pin (277), so that the first ball seat (262) is allowed to move downwardly further to the recess portion (268), thereby forming a circulation channel for pressure relief.

5. The coring tool according to claim 4, wherein the first actuating member (273) further comprises a flange (266) configured to engage a lower step in the recess portion (268), thereby forming a force-transferring connection between the outer positioning member (271) and the first actuating member (273).

6. The coring tool according to claim 4, wherein the suspension unit (260) further comprises a second pressure-building mechanism (263) configured to allow a downhole fluid to flow through the coring tool prior to being actuated, and to allow the coring tool to enter the first state after being actuated.

7. The coring tool according to claim 6, wherein the differential unit (210) comprises a first jaw joint (220) and a second jaw joint (230) that are connected to each other in a moveable but non-rotatable manner, a third locking mechanism (240) for selectively locking or releasing relative movement between the first jaw joint (220) and the second jaw joint (230), and a second actuating member (225) for actuating the third locking mechanism (240), wherein a lower end of the first jaw joint (220) is fixedly connected to the outer positioning member (271) of the suspension unit (260), and a lower end of the second jaw joint (230) is affixed to an upper end of the housing (100).

8. The coring tool according to claim 7, wherein the third locking mechanism (240) comprises a third through slot (241) arranged within the second jaw joint (230), and a third locking block (242) extending through the third through slot (241), wherein an outer end of the third locking block (242) extends into a third blind slot (243) formed in an inner surface of the first jaw joint (220), while an inner end thereof engages with the second actuating member (225).

9. The coring tool according to claim 8, wherein the differential unit (210) comprises a third pressure-building mechanism (211), the first jaw joint (220) and the second actuating member (225) connected to each other through a fourth shear pin (228); and the third pressure-building mechanism (211) is configured to be actuated in the third state to shear off the fourth shear pin (228), thereby allowing the second actuating member (225) to move downwardly and the third locking block (242) to move inwardly in a radial direction, so that the third locking mechanism (240) is released, and the first jaw joint (220) and the second jaw joint (230) are movable relative to each other.

10. The coring tool according to claim 9, wherein the differential unit (210) further comprises an outer adjusting member (250) and an inner adjusting member (255), wherein the outer adjusting member (250) is arranged on an inner side of the second jaw joint (230), and fixedly connected to the lower end of the first jaw joint (220), and the inner adjusting member (255) is arranged on and fixedly connected to an inner side of the outer adjusting member (250), and has a lower end thereof fixedly connected to the outer positioning member (271).

11. The coring tool according to claim 9, wherein the coring bit (500) comprises an inner cavity (520) having an inner cone portion (530);

the first core gripper is configured as a retractable core gripper (350), and the second core gripper is configured as a slip-collar type core gripper (360) arranged upstream of the retractable core gripper; and the shielding mechanism (310) comprises an inner sliding sleeve (312) and an outer sliding sleeve (318), wherein an upper end of the inner sliding sleeve (312) is fixedly connected to the first actuating member (273) of the suspension unit (260), a lower end of the outer sliding sleeve (318) is fixedly connected to the retractable core gripper (350), and the slip-collar type core gripper (360) is arranged within a space (305) formed between the inner sliding sleeve (312) and the outer sliding sleeve (318), the inner sliding sleeve (312) being connected to the outer sliding sleeve (318) through a releasable first locking mechanism (320).

12. The coring tool (1000) according to claim 11, wherein the first locking mechanism (320) comprises a first shear pin (315) connecting the outer sliding sleeve (318) with the inner sliding sleeve (312), a first locking block (321) extending outwardly in a radial direction from a circumferential surface of the outer sliding sleeve (318), and a step (155) formed on an inner surface of the housing (100), wherein the first shear pin (315) is configured to be sheared off by the upward pulling force, and the step (155) is configured to prevent movement of the outer sliding sleeve (318) via engagement with the first locking block (321), so that the inner sliding sleeve (312) is movable upwardly relative to the outer sliding sleeve (318).

13. The coring tool according to claim 12, wherein a lower end of the inner sliding sleeve (312) is provided with a shield cover (322) having a decreasing outer diameter, and a fixing sleeve (328) is connected to the lower end of the outer sliding sleeve (318), wherein the retractable core gripper (350) is fixedly connected to a lower end of the fixing sleeve (328), and the slip-collar type core gripper (360) is fixed to a radial inner side of the fixing sleeve (328) and arranged on a radial outer side of the shield cover (322).

14. A coring method performed through the coring tool (1000) according to claim 11, comprising:

Step A, actuating the second pressure-building mechanism (263), so that the coring tool enters the first state to perform the coring operation;

Step B, actuating the first pressure-building mechanism (261), so that the coring tool enters the second state to perform the first core cutting operation, and Step C, actuating the third pressure-building mechanism (211), so that the coring tool enters the third state to perform the second core cutting operation.

15. The coring method according to claim 14, wherein in Step B, a first force provided by the first pressure-building mechanism (261) shears off the second shear pin (277), pushing the inner positioning member (272) to move downwardly to release the second locking mechanism (275), so that the first force is transferred to the inner sliding sleeve (312) to push the core gripping device (300) to move downwardly, whereby the retractable core gripper (350) performs the first core cutting operation, while the slip-collar type core gripper (360) is shielded by the shielding mechanism (310).

16. The coring method according to claim 15, wherein in Step C, a second force provided by the third pressure-building mechanism (211) shears off the fourth shear pin (228), pushing the second actuating member (225) to move downwardly to release the third locking mechanism (240), so that the first jaw joint (220) and the second jaw joint (230) are movable relative to each other, whereby the inner sliding sleeve (312) is movable upwardly relative to the outer sliding sleeve (318) by pulling the first jaw joint (220) upwardly to expose the slip-collar type core gripper (360) to perform the second core cutting operation.

17. The coring method according to claim 16, wherein Step B further comprises shearing off the third shear pin (279) by continuous pressure building-up, so that the first pressure-building mechanism (261) further moves downwardly to form a circulation channel for pressure relief to perform pressure relief operation.

* * * * *